United States Patent [19]

Wang et al.

[11] Patent Number: 4,564,438

[45] Date of Patent: Jan. 14, 1986

[54] STYRENE-DIALKYL MALEATE COPOLYMERS AS DEWAXING AGENTS

[75] Inventors: Sophia Wang, Houston; Alan A. Millard, Richmond, both of Tex.

[73] Assignee: Nalco Chemical Company, Oak Brook, Ill.

[21] Appl. No.: 739,644

[22] Filed: May 31, 1985

[51] Int. Cl.[4] ..... C10G 73/04

[52] U.S. Cl. ..... 208/33

[58] Field of Search ..... 208/33, 31, 29, 28; 252/56 R

[56] References Cited

U.S. PATENT DOCUMENTS

| | | | |
|---|---|---|---|
| 3,390,089 | 6/1968 | Tirtiaux et al. | 252/56 R |
| 3,451,920 | 6/1969 | De Vault et al. | 208/33 |
| 3,458,430 | 7/1969 | Henselman et al. | 208/33 |
| 3,729,296 | 4/1973 | Miller | 208/33 |
| 4,073,738 | 2/1978 | Ladenberger et al. | 252/56 R |
| 4,460,453 | 7/1984 | Gudelis et al. | 208/33 |
| 4,496,691 | 1/1985 | Proux et al. | 252/56 R X |

*Primary Examiner*—John Doll

*Assistant Examiner*—Glenn Caldarola

*Attorney, Agent or Firm*—John G. Premo; Donald G. Epple

[57] ABSTRACT

A solvent dewaxing process for dewaxing waxy lubricating oil with a dewaxing solvent and a dewaxing aid which comprises using as the dewaxing aid a styrene dialkyl maleate copolymer wherein the side chain groups contain from $C_{16}$-$C_{24}$+ carbon atoms. These polymers are further characterized as having a molecular weight within the range of 10,000–150,000.

4 Claims, No Drawings

STYRENE-DIALKYL MALEATE COPOLYMERS AS DEWAXING AGENTS

INTRODUCTION

Background of the Invention

Waxes in wax-containing hydrocarbon oils are removed therefrom by chilling the oil to precipitate out the wax and then separating the solid wax particles from the dewaxed oil by solid/liquid separation procedures such as filtration, centrifugation, settling, etc. Industrial dewaxing processes include press dewaxing processes wherein the wax-containing oil, in the absence of solvent, is chilled to crystallize out the wax particles which are then pressed out by a filter. In general, only light hydrocarbon oil fractions are treated by press dewaxing processes due to viscosity limitations. More widely used are solvent dewaxing processes wherein a waxy oil is mixed with a solvent and then chilled to precipitate the wax as tiny particles or crystals, thereby forming a slurry comprising solid wax particles and a solution of dewaxed oil-containing dewaxing solvent. The slurry is then fed to a wax separator (e.g. filter) wherein the wax is removed from the dewaxed oil and dewaxing solvent. Solvent dewaxing processes are used for heavier oil fractions such as lubricating oil distillates and bright stocks. Typical dewaxing solvents include low boiling point, normally gaseous autorefrigerative hydrocarbons such as propane, propylene, butane, pentane, etc., and normally liquid solvents, e.g. ketones such as acetone, methyl ethyl ketone (MEK), methyl isobutyl ketone (MIBK) and mixtures thereof, aromatic hydrocarbons such as benzene, toluene and xylene as well as mixtures of ketones and aromatic hydrocarbons such as MEK/-toluene and acetone/benzene and mixtures of normally liquid solvents such as ketones with autorefrigerants such as acetone/propylene.

One of the factors tending to limit the capacity of a solvent dewaxing plant is the rate of wax filtration (and separation in general) from the dewaxed oil, which in turn is strongly influenced by the crystal structure of the precipitated wax. Although the crystal structure of the precipitated wax is influenced by various operating conditions in the dewaxing process, for any given feed, it is most strongly influenced by the chilling conditions. The size and structure of the precipitated wax crystals, occlusion of oil in the wax crystal, and the condition and quantity of the oil left in the crystal are extremely varied and depend on the wax composition and precipitation conditions. These conditions also effect the separation (e.g. filtration) rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil.

One way of improving the filtration rate and minimizing haze formation is to add a dewaxing aid to the wax-containing oil during the dewaxing process. Well known in the industry are dewaxing aids such as a-olefin copolymers; mixtures of materials such as a mixture of (a) an ethylene-vinyl acetate copolymer and (b) an ester of an aliphatic alcohol having from 2 to 20 carbon atoms with acrylic or methacrylic acid; materials such as the esters of aliphatic alcohols and acrylic or methacrylic acid, as well as polymeric dewaxing aids comprising condensation products of chlorinated paraffins and naphthalenes alone or mixed with the aforementioned esters. However, in the case of heavy stocks, these aids are not too efficient, requiring a relatively high concentration of the dewaxing aid in the oil. This is especially true when a heavy oil raffinate or a bright stock or heavy distillate is solvent dewaxed. Because of the presence of many fine particles of wax in the oil, the filter rate of the dewaxed oil tends to be low and the oil also may possess or develop a haze.

THE INVENTION

The invention relates to a process for solvent dewaxing waxy lubricating oils which comprises using as a dewaxing aid a styrene dialkyl maleate copolymer wherein the alkly side chain groups contain from $C_{16}$–$C_{24}$+ carbon atoms. The alkly side chain groups are preferably a mixed straight chain averaging $C_{18}$–$C_{20}$ carbon atoms. This hydrocarbon group is obviously derived from an aliphatic alcohol. Such alcohols are readily available as products of the so-called "oxo" process or natural process.

The copolymers of the invention have a molecular weight within the range of 10,000 to about 150,000 with a typical polymer useful in the practice of the invention having a molecular weight as determined by gel permeation chromatography vs. polystyrene standards of about 43,000.

Preparation of the Copolymers

The dewaxing aid is readily prepared in two steps. Styrene and maleic anhydride are mixed at 1:1 ratio in a suitable solvent such as toluene and heated to a temperature suitable for decomposition of organic peroxide polymerization initiators. Typically, the solution is heated to 90° C. and tert-butyl peroctoate is added to initiate polymerization.

When polymerization is judged complete, usually by IR analysis, two moles of alcohol, based on maleic anhydride, are added to the mixture along with a strong acid esterification catalyst. The mixture is heated to reflux and the water formed during esterification is removed as the toluene azeotrope. Typically, a mixture of straight chain synthetic alcohols of carbon number 18 or higher is used as the alcohol source. The strong acid preferred is methane sulfonic, but p-toluene sulfonic and other organic sulfonic acids can be used as esterification catalyst.

The Dewaxing Solvents

The dewaxing solvent that is used in the present invention is not particularly critical; thus, any of the well-known normally liquid dewaxing solvents can be used. For example, ketones having from 3 to 6 carbon atoms, such as acetone, dimethyl ketone, methyl ethyl ketone, methyl propyl ketone and methyl isobutyl ketone and mixtures thereof, aromatic hydrocarbons such as benzene, xylene or toluene, mixtures of ketones and aromatic hydrocarbons such as methyl ethyl ketone/toluene or methyl isobutyl ketone/toluene. Also useful are halogenated hydrocarbons such as methylene chloride. Further, N-alkylpyrrolidones such as N-methylpyrrolidone and N-ethyl-pyrrolidone may be used as components of the dewaxing solvent. Normally liquid solvents which may be especially preferred for practicing the process of the present invention include aromatic hydrocarbons such as toluene, $C_4$–$C_6$ ketones such as MEK, MIBK and mixtures thereof, mixtures of a ketone and an aromatic hydrocarbon such as MEK/-toluene, halogenated hydrocarbons such as methylene chloride, and mixtures of acetone and methylene chloride.

Treatment of the Waxy Lubricating Oils with the Copolymers

The product may be used as is or concentrated or diluted depending on the needs and desires of each user. The product is injected into the feed to be dewaxed at 0.001 to 2 percent by weight, preferably 0.002 to 2, and most preferably 0.0075 to 0.25 percent by weight, active ingredient, then mixed with solvent and heated to 75° C., then the mixture is chilled to the filtration temperature. This chilling causes the wax to precipitate and form a slurry of wax in oil/solvent liquid. The aid is contained in the wax. This slurry is then fed to a filtration system which holds the wax, allowing the oil/solvent liquid to pass through. This is the step where the aid becomes important. Use of aid increases filtration rates. It enhances separation, i.e. less wax in the finished oil and less oil in the finished wax. It can also allow the use of less solvent in the process, thus increasing the overall efficiency of the process.

The Waxy Lubricating Oils

The waxy lubricating oils may be a bright stock raffinate from such typical sources as Light Arabian, Kuwait, North Louisiana, West Texas Sour, Western Canadian, Cold Lake Heavy Crude, etc. The lubricating oils also can be derived from a crude oil or mixture of crude oils formed by vacuum distillation followed by conventional propane deasphalting of the vacuum residuum to remove the asphaltenes. The resulting deasphalted oil is solvent extracted using either NMP, phenol, or furfural, etc. to remove the remaining undesirable aromatics to give a waxy lubricating oil for subsequent dewaxing. Typical waxy lubricating oils have a boiling range of about 500°- 700° C., density of about 0.85-0.92 g/cc @ 15° C., a viscosity of about 25-37 cSt/100° C., a pour point of 60°-70° C., a dry wax content of 15-25 wt. % for about −9° C. pour point and a conradson carbon residue value of about 0.3-2.0. A sample of a typical bright stock, Arab Light 2500N, was examined and was found to have a boiling range of 500°-700° C., a density of 0.89 g/cc @ 15° C., a viscosity of 32 cSt/100° C., a pour point of 65° C. and a dry wax content of 16 wt. %. Preferably the waxy lubricating oil is a lube oil or specialty oil fraction.

ILLUSTRATION OF THE INVENTION

This aid has been shown to be superior to other commercial dewaxing aids and very superior to no aid in both the lab and the field and in both hydrocarbon and ketone/aromatic hydrocarbon systems.

EXAMPLE 1

The invention was tested under laboratory conditions and compared to other products tested under identical conditions. The aids were added to a waxy bright stock, then diluted with heptane. The ratio of solvent to waxy bright stock was 3:1. The mixture was heated to 170° F. and stirred until a homogeneous solution formed. The mixture was then flash-cooled to −35° F. The cooling period was 20 minutes. A filtration device was inserted into the slurry. The device consists of a graduated receiver attached directly to a filter. Vacuum is attached on the opposite side of the receiver to the filter. A vacuum of 12" $H_2O$ was applied to the filter. The amount of liquid that passes through filter into the graduated receiver and the time taken to reach maximum volume are both measures of filterability. The greater the volume and the shorter the time are measures of better filterability. Results of laboratory testing are shown in Table I

TABLE I

| | Laboratory Evaluation of Invention in Waxy Bright Stock | | | | |
|---|---|---|---|---|---|
| Run # | 1 | 2 | 3 | 4 | 5 |
| Dewaxing Aid | Commercial | Commercial | Commercial | Invention | Blank |
| Dosage (ppm based on total was plus solvent) | 1000 | 1000 | 1000 | 1000 | 0 |
| Filtration volume % based total vessel size | 10 | 0 | 25 | 80 | 0 |
| Time (sec) to fill to % | 60 | NA | 60 | 45 | NA |

EXAMPLE 2

The invention was evaluated in a commercial MEK/-toluene dewaxing unit. This unit was run under the following conditions. Solvent to waxy heavy neutral oil ratio was 2.8-3.1:1. The solvent was composed of 55% MEK and 45% toluene. The target filtration temperature was −8° to −10° F. with actual operation fluctuating in the −5° to −10° F. range. The unit was operated under the above conditions for 48 hours without aid to establish a baseline. Injection of aid was begun and the feed rate of the waxy neutral oil increased incrementally in 8%, based on original feed rate, increments. The feed rate increased 38% for 24 hours when 225 ppm of aid, based on waxy feed, was added. Increasing the amount of aid to 300 ppm showed no additional benefit. The feed rate was maintained at 31% increase for an additional 48 hours at 225 ppm aid. The aid injection was then terminated. The feed rate had to be reduced to 88% of the original feed rate and 68% of the increased feed rate to maintain unit operability. The unit was then operated at the reduced rate for 12 hours. Subsequently, the aid injection was resumed and the feed rate increased to 32% of original and 50% of immediately previous rate.

We claim:

1. A solvent dewaxing process of the type wherein a waxy lubricating oil is treated with a dewaxing solvent and a dewaxing aid, the improvement which comprises using as the dewaxing aid a styrene dialkyl maleate copolymer wherein the alkyl side chain group contains from $C_{16}$-$C_{24}$+ carbon atoms, said copolymer having a molecular weight within the range of 10,000-150,000.

2. The solvent dewaxing process of claim 1 wherein the alkyl side chain group contains $C_{18}$-$C_{20}$ carbon atoms and the molecular weight is about 43,000.

3. The solvent dewaxing process of claim 1 wherein the dewaxing aid is used at a dosage ranging between 0.001 to 2 percent by weight based on the weight of the lubricating oil.

4. The method of claim 3 where the dosage is within the range of 0.0075 to 0.25 percent by weight.

* * * * *